US006254727B1

(12) United States Patent
Moser

(10) Patent No.: US 6,254,727 B1
(45) Date of Patent: Jul. 3, 2001

(54) TWO-WIRE FORMER AND METHOD FOR OPERATING THE SAME

(75) Inventor: Johann Moser, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/310,745

(22) Filed: May 13, 1999

(30) Foreign Application Priority Data

Jun. 25, 1998 (DE) ..... 198 28 237

(51) Int. Cl.[7] ..... D21F 1/00
(52) U.S. Cl. ..... 162/203; 162/301; 162/352
(58) Field of Search ..... 162/203, 300, 162/301, 352

(56) References Cited

U.S. PATENT DOCUMENTS

| | | | | |
|---|---|---|---|---|
| 5,116,477 | * | 5/1992 | Bubik et al. | 162/300 |
| 5,167,770 | * | 12/1992 | Bubik et al. | 162/301 |
| 5,262,009 | | 11/1993 | Schiel et al. | 162/252 |
| 5,395,484 | | 3/1995 | Odell et al. | 162/203 |
| 5,536,372 | | 7/1996 | Odell et al. | 162/203 |
| 5,573,643 | | 11/1996 | Jaakkola et al. | 162/203 |
| 5,582,687 | | 12/1996 | Odell et al. | 162/203 |
| 5,914,009 | * | 6/1999 | Kotitschke | 162/301 |

FOREIGN PATENT DOCUMENTS

| | | |
|---|---|---|
| 2548794 | 4/1977 | (DE) . |
| 9105328 | 8/1991 | (DE) . |
| 19652485 | 6/1998 | (DE) . |
| 552139 | 7/1993 | (EP) . |
| 95/34713 | 12/1995 | (WO) . |

* cited by examiner

*Primary Examiner*—Karen M. Hastings
(74) *Attorney, Agent, or Firm*—Greenblum & Bernstein, P.L.C.

(57) ABSTRACT

A twin-wire former adapted to form a web of fibrous material is provided. First and second endless circulating wire bands define a twin-wire zone therebetween, and form the web of fibrous material therebetween. The first and second wire bands run over a forming roll in the twin-wire zone, where the first wire band contacts the forming roll. A reel-off point is defined as the point at which the first and second wire bands disengage from the forming roll. At least one support device extends crosswise over the second wire band. The support device is a hinged foil skimmer, and is disposed in a region of the reel-off point, and contacts the second wire band. Movement of the second wire band relative to the at least one supporting device creates an area of reduced air pressure therebetween. The method includes moving the first and second wire bands adjacent a forming roll such that the first wire band contacts the forming roll. The first and second wire bands disengage from the forming roll at a reel-off point. A reduced air pressure is generated adjacent a side of the second wire band facing away from the forming roll, in a region of the reel-off point. The distance between the hinge and the second wire band is variable to adapt the angle of inclination between a foil surface of the skimmer and the second wire band to thereby adapt the magnitude of reduced air pressure.

15 Claims, 4 Drawing Sheets

TWO-WIRE FORMER AND METHOD FOR OPERATING THE SAME

CROSS-REFERENCE OF RELATED APPLICATIONS

The present application claims priority under 35 U.S.C. §119 of German Patent Application No. 198 28 237.0, filed Jun. 25, 1998, the disclosure of which is expressly incorporated by reference herein in its entirety

BACKGROUND OF THE INVENTION

1. Field of the Invention

The present invention is directed to a twin-wire (i.e., a two-wire) former. More particularly, the present invention is directed to a twin-wire former used in the formation of a web of fibrous material from a fiber suspension, in particular as part of a paper production machine.

2. Discussion of the Background Information

German patent application 196 52 485.7 discloses a twin-wire former having two endless circulating wire belts or bands, which together form a twin-wire zone. The web of fibrous material forms between the twin-wire bands in the region of the twin-wire zone. At the twin-wire zone, the twin-wire bands move together over a forming roll, by which one wire band (the "inner wire band") comes into direct contact with the forming roll. At the reel-off point of the twin-wire bands from the forming roll, the other wire band (the "outer wire band") contacts at least one support device extending crosswise over the wire band, such as a skimmer. This skimmer may be rigidly attached to the frame of the machine or preferably) pressed against the outer wire band (for example, by a pneumatic hose). In each such embodiment, transitory divergence of the twin-wire bands (wire separation) is undesirable, and should be avoided using the skimmer at the reel-off point by applying tension to the wire bands in the direction of travel of the fiber web. However, divergence of the twin-wire bands is still occasionally observed, even though tension is applied as noted above. Such divergence disrupts the proper formation of the web.

By using a skimmer that can be pressed against the outer wire band, the position of the skimmer automatically adjusts to the actual layer thickness of the fiber suspension located between the twin-wire bands. A similar technique is shown in WO 95/34713. Nonetheless, disruptions of proper web formation are still observed in the finished web. For example, in a nonuniform basis weight-crosswise profile, the paper web makes a cloudy impression (on observation against a light source), whereby the cloudiness is sometimes strong and/or nonuniform. In other words, the quality of the "formation" is unsatisfactory.

SUMMARY OF THE INVENTION

The present invention is directed to overcoming the drawbacks of the prior art. This is accomplished by providing a twin-wire former that reduces divergence of the wire bands, to thereby improve the overall quality of the resultant web.

The above is further accomplished by forming a vacuum zone, for example, by a so-called foil skimmer, in the region of the reel-off point of the wire bands from the forming roll on the side of the outer wire band. Such a foil skimmer, disclosed in, for example, DE 91 05 328 and U.S. Pat. No. 5,262,009, the disclosure of which is expressly incorporated by reference herein in its entirety, has a slide surface in contact with the wire band and a so-called foil surface connected thereto, which is tilted counter to the direction of travel of the wire, whereby it diverges from the wire band in the direction of travel of the wire. A vacuum zone is thereby created in the wedge opening between the outer wire band and the foil surface through the motion of the wire band.

The aforementioned vacuum zone acts to increase the quality of the finished paper web, i.e., it largely avoids defects in the basis weight-crosswise profile and the observed cloudiness. In other words, significantly improved "formation" quality is obtained. This effect appears to derive from the fact that a similar vacuum develops in the wedge that is always present between the inner wire band reeling off and the jacket of the forming roll, The present invention establishes a counter balancing vacuum zone on the outer band. In other words, the vacuum generated by the foil skimmer (or a vacuum shoe, a vacuum box, etc.) counteracts the vacuum developing on the forming roll such that the negative effect of the latter is neutralized, or at least reduced.

The slide surface of the foil skimmer preferably contacts the outer wire band by flexibly pressing against the outer wire band. Thus, the advantage is obtained that the foil skimmer automatically adapts to different suspension depths. For this purpose, the foil skimmer (seen in a cross-section through the foil skimmer) is preferably supported in its downstream region (relative to the belt travel direction) by a hinge (i.e., a joint) on a stationary or adjustable component, and is pressed against the outer wire in its upstream region by means of a flexible positioning device, such as a pneumatic hose.

According to an exemplary embodiment of the present invention, a twin-wire former adapted to form a web of fibrous material is provided. First and second endless circulating wire bands define a twin-wire zone therebetween, and are adapted to form the web of fibrous material therebetween. A forming roll is provided. The first and second wire bands run over the forming roll in the twin-wire zone, where the first wire band contacts the forming roll. A reel-off point is the point at which the first and second wire bands separate from the forming roll. At least one support device extends crosswise over the second wire band. The support device is disposed in a region of the reel-off point, and contacts the second wire band. Movement of the second wire band relative to the at least one supporting device creates an area of reduced air pressure therebetween.

The at least one support device is preferably a skimmer having a slide surface contacting the second wire band, and a foil surface connected thereto in a direction of travel of the wire. The skimmer is preferably pressed flexibly at the slide surface against the second wire band. A downstream region of the skimmer is preferably supported by a hinge, and an upstream region of the skimmer is preferably supported by a flexible adjustment device. The flexible adjustment device is preferably a pneumatic hose.

In another feature of the exemplary embodiment, a distance between the hinge and the second wire band is variable to vary an angle of inclination between the foil surface and the second wire band, and thereby vary the magnitude of the reduced air pressure.

For a further feature of the exemplary embodiment, a position of the at least one support device is movable along a direction substantially parallel to a direction of travel of the second wire band. The at least one support device is preferably one of a suction shoe and a suction box, and is preferably flexibly pressed against the second wire band. The at least one support device is also preferably disposed inside a loop defined by the second wire band, and the forming roll is disposed inside a loop defined by the first wire band, in which the first wire band is below the second wire band. The at least one support device is also preferably disposed inside a loop defined by the second wire band, and the forming roll is disposed inside a loop defined by the first wire band, in which the first wire band is above the second wire band.

In accordance with another feature of the exemplary embodiment, the first and second wire bands run upwardly or downwardly between the forming roll and the at least one support device.

According to another embodiment of the present invention, a twin-wire former adapted to form a web of fibrous material is provided. First and second endless circulating wire bands are adapted to form the web of fibrous material therebetween, A forming roll is provided. The first and second wire bands run over the forming roll such that the first wire band contacts the forming roll. A reel-off point is defined by the point at which the first and second wire bands separate from the forming roll. At least one support device extending crosswise over the second wire band, is disposed in a region of the reel-off point, and contacts the second wire band. Movement of the second wire band relative to the at least one supporting device creates an area of reduced air pressure therebetween that assists in maintaining the second wire band at a desired alignment relative to the first wire band.

In accordance with a feature of the above embodiment, the at least one support device is preferably a skimmer having a slide surface contacting the second wire band, and a foil surface connected thereto in a direction of travel of the wire. The skimmer is preferably pressed flexibly at the slide surface against the second wire band. A downstream region of the skimmer is preferably supported by a hinge, and an upstream region of the skimmer is preferably supported by a flexible adjustment device. The flexible adjustment device is preferably a pneumatic hose.

In accordance with another feature of the above embodiment, a distance between the hinge and the second wire band is variable to vary an angle of inclination between the foil surface and the second wire band, and thereby vary the magnitude of the reduced air pressure.

According to yet another embodiment of the present invention, a twin-wire former adapted to form a web of fibrous material is provided. First and second endless circulating wire bands are adapted to form the web of fibrous material therebetween. A forming roll is provided. The first and second wire bands run over the forming roll, and the first wire band contacts the forming roll. A reel-off point is defined by the point at which the first and second wire bands separate from the forming roll. A foil skimmer extending crosswise over the second wire band, is disposed in a region of the reel-off point, and contacts the second wire band. Movement of the second wire band relative to the foil skimmer creates an area of reduced air pressure therebetween that at least partially offsets deviation in at least one of the first and second bands induced by another area of reduced air pressure between the first wire band and the forming roll in a region of the reel-off point.

In accordance with another embodiment of the present invention, a method for operating a twin-wire former adapted to form a web of fibrous material is provided. The twin-wire former includes first and second wire bands defining a twin-wire zone therebetween, and adapted to form the web of fibrous material therebetween. The method includes moving the first and second wire bands adjacent a forming roll such that the first wire band contacts the forming roll, disengaging the first and second wire bands from the forming roll at a reel-off point, and generating a reduced air pressure adjacent a side of the second wire band facing away from the forming roll, in a region of the reel-off point.

The above generation of reduced air pressure preferably includes providing a support structure adjacent the side of the second wire band in the region of the reel-off point, such that the second wire band contacts the support structure during the moving.

BRIEF DESCRIPTION OF THE DRAWINGS

The present invention is further described in the detailed description that follows, in reference to the noted plurality of drawings by way of non-limiting examples of exemplary embodiments of the present invention, in which like reference numerals represent similar parts through the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than necessary for the fundamental understanding of the present invention, the description taken with the drawings making apparent to those skilled in the art how the several forms of the present invention may be embodied in practice.

Figure 1:
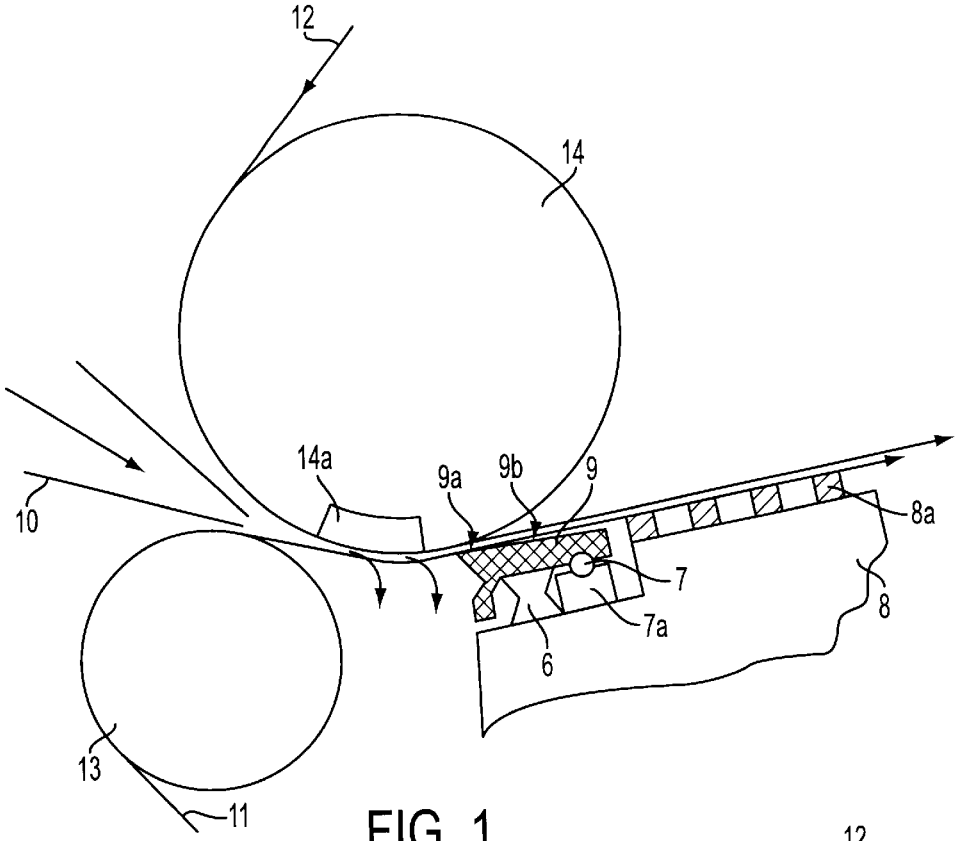
FIG. 1 is a side view of an exemplary embodiment of the invention.

Referring to FIG. 1, a breast roll 13, a forming roll 14, an inner wire band 12 and an outer wire band 11 form a twin-wire former that defines a twin-wire zone. Inner wire band 12 comes into direct contact with forming roll 14. Outer wire band 11 comes into direct contact with the breast roll 13, and runs to the forming roll 14.

A headbox 10 feeds a fiber suspension stream into an intake wedge (defined by the twin-wire bands 11 and 12). The twin-wire bands 11 and 12 together now overlap a relatively small region of the jacket of the forming roll 14. A suction zone 14*a* may be located in this region. A large portion of the suspension water flows through the mesh of the outer wire band 11; and a smaller portion flows into the interior of the forming roll 14. Thus, the web of fibrous material begins to form between the twin-wire bands 11 and 12.

At the reel-off point of wire bands 11 and 12 from forming roll 14 (i.e., at the point where wire bands 11 and 12 disengage forming roll 14), outer wire band 11 contacts a support device 9, a so-called foil skimmer in FIG. 1. This has a slide surface 9*a* contacting outer wire band 11 and a foil surface 9*b* connected thereto in the direction of travel of the wire. Foil surface 9*b* diverges from the outer wire band 11 at a small angle of, for example, approximately 1 to 5°. Thus, an area of reduced air pressure (a "vacuum zone") forms between foil surface 9*b* and outer wire band 11 due to the motion of outer wire band 11 relative to support device 9.

Foil skimmer 9 is, by way of non-limiting example, a component of a dewatering box 8 that has additional skimmers 8*a* to guide wire bands 11 and 12. To support foil skimmer 9, a bearing block 7*a* supports a downstream region of the foil skimmer 9 by a hinge 7. The upstream region of the foil skimmer 9 with the slide surface 9*a* is, in contrast, pressed flexibly against the outer wire band 11, preferably by a pneumatic hose 6 having a finely adjustable force.

Figure 2:
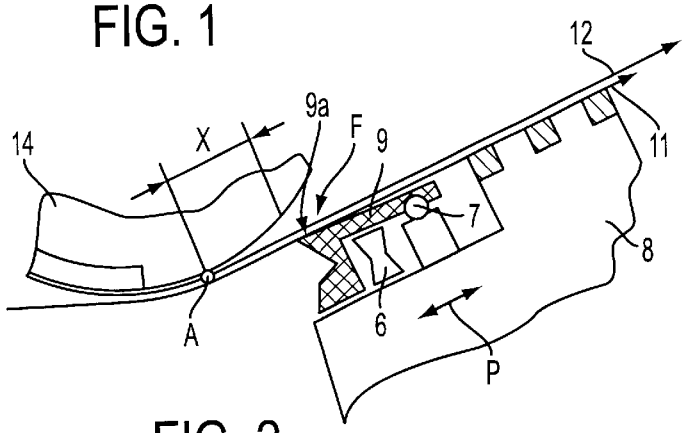
FIG. 2 is a side view of a variation of the exemplary embodiment of the invention.

In FIG. 1, the slide surface 9*a* of the foil skimmer 9 is located in the immediate vicinity of the reel-off point at which wire bands 11 and 12 disengage from forming roll 14. Referring now to FIG. 2, slide surface 9*a* can also be positioned to contact outer wire band 11 a slight distance x downstream from (i.e., after) the reel-off point A. By moving dewatering box 8 along the direction arrow P, any intermediate position may be obtained. Thus, the position of vacuum zone between the foil skimmer 9 and the outer wire band 11 is adjustable. Positioning slide surface 9*a* upstream (i.e., before) the reel-off point A is likewise possible.

Thus, a vacuum develops in the wedge F between the forming roll 14 and the outer wire 12, which effectively prevents disruption in the formation of the web of fibrous material by preventing wire bands 11 and 12 from diverging from their intended paths.

Figure 3:
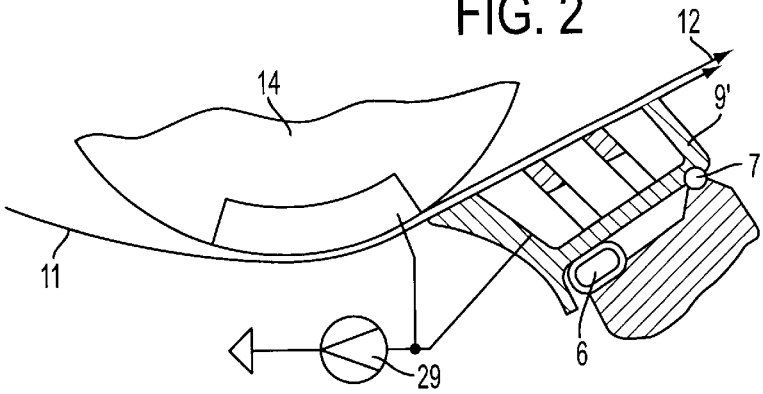
FIG. 3 is a side view of another variation of the exemplary embodiment of the invention.

Referring now to FIG. 3, a suction zone is formed at the reel-off point of wire bands 11 and 12 from the forming roll 14 by a suction shoe 9'. Suction shoe 9' rests on a hinge 7 and can be flexibly pressed against outer wire band 11, preferably by a pneumatic hose 6. The interior of the suction shoe 9', which is open to outer wire band 11, connects to a vacuum source 29.

Figure 4:
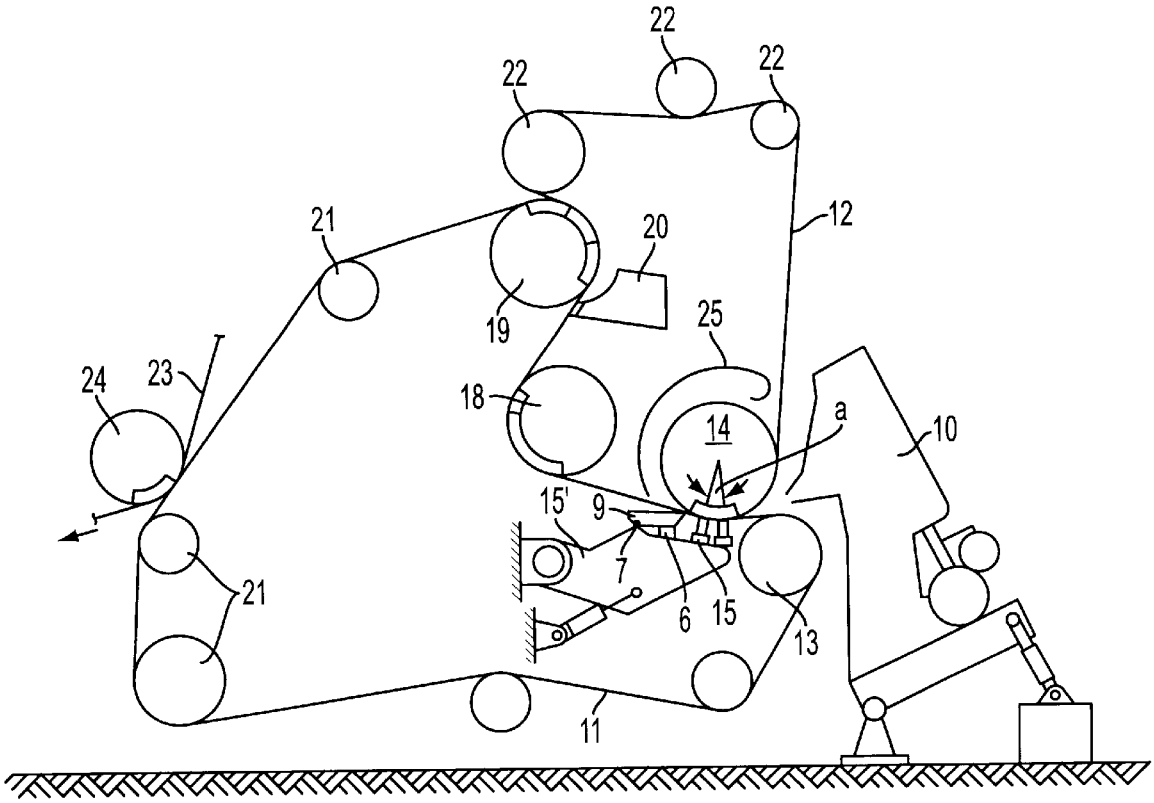
FIGS. 4–7 are side views of different paper making machines using the present invention.

Referring now to FIG. 4, a headbox 10, two endless wire bands 11 and 12, a breast roll 13, and forming roll 14 are shown. Forming roll 14 contacts the twin-wire bands over a small sector "a" (approximately over an angle between approximately 10 and 40° of the circumference of forming roll 14). From the forming roll 14, wire bands 11 and 12 run (together with the web of fibrous material forming between them) over a first suction roll 18 and then over a second suction roll 19. After second suction roll 19, inner wire band 12 separates from the web of fibrous material and circles over guide rolls 22 back to forming roll 14. The outer wire band 11 continues to guide the web of fibrous material until it is picked up by a take-up felt 23 and a take-up roll 24. The outer wire band 11 runs over guide rolls 21 and circles back to breast roll 13.

A pivotable support device 15' is positioned in the loop defined by the path of outer wire band 11. Foil skimmer 9, described above, and two formation skimmers 15 that can be flexibly pressed against the forming roll 14 in the twin-wire zone, are mounted on support device 15'. In this arrangement, outer wire band 11 is a bottom wire band and inner wire band 12 is a top wire band. Foil skimmer 9 is thus pressed against the bottom wire band 11 upwardly in the direction of forming roll 14. In view of the above discussion and as shown in FIG. 4, a distance between said hinge and said second wire band is variable to adapt an angle of inclination between said foil surface and said second wire band, and thereby the magnitude of said reduced air pressure.

Figure 5:
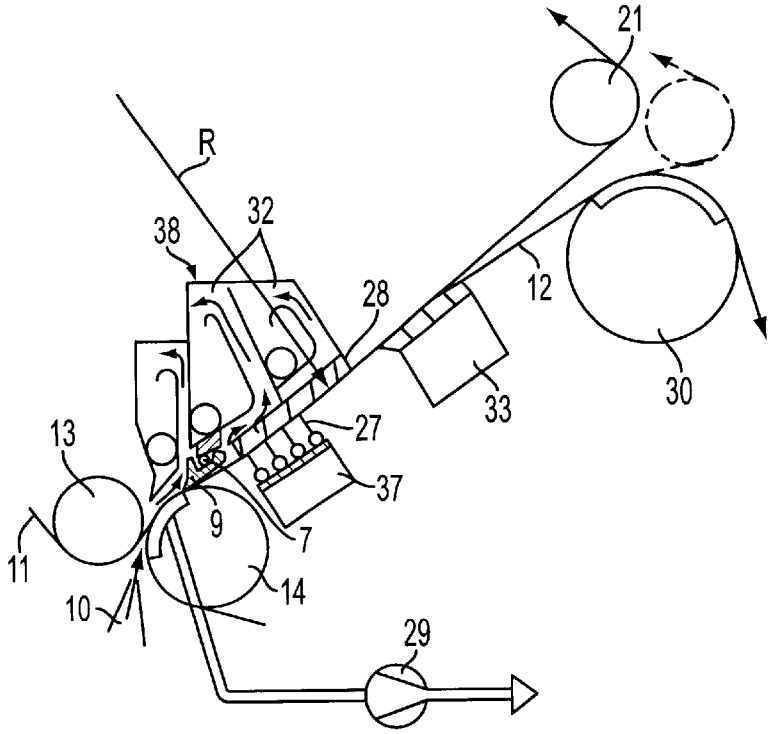

Referring now to FIG. 5, wire bands 11 and 12 run diagonally upwardly after forming roll 14. Immediately at the reel-off point of wire bands 11 and 12 from forming roll 14, outer wire band 11 contacts a foil skimmer 9, which (as described above) forms a vacuum zone with outer wire band 11.

In FIG. 5, outer wire band 11 is a top wire band and inner wire band 12 a bottom wire band, such that the foil skimmer 9 is pressed from the top downwardly against the outer wire band 11. Hinge 7 on a stationary component, preferably an upper dewatering box 38, supports foil skimmer 9. This bulges slightly downwardly (with a large radius of curvature R). On the bottom of the dewatering box 38, there is a group of skimmers 28 fixedly connected to the box 38, over which outer wire band 11 slides. Vacuum chambers 32 in box 38 remove suspension water that is forced upwardly.

A lower dewatering box 37 is provided inside the loop defined by the inner wire band 12. This supports a plurality of so-called formation skimmers 27, which can be pressed flexibly against inner wire band 12 from below, preferably by individually controllable pneumatic hoses. A suction separator 33 is positioned downstream in the twin-wire zone at which outer wire band 11 separates from inner wire band 12. Inner wire band 12 continues to transport the web of fibrous material, initially over a wire suction roll 30. In the alternative, outer wire band 11 may not separate from inner wire band 12 before reaching the circumference of wire suction roll 30, as indicated by the broken line in FIG. 5. In another alternative, wire bands 11 and 12 may run through the twin-wire zone essentially vertically upwardly, starting from the breast roll 13 and the forming roll 14.

Figure 6:
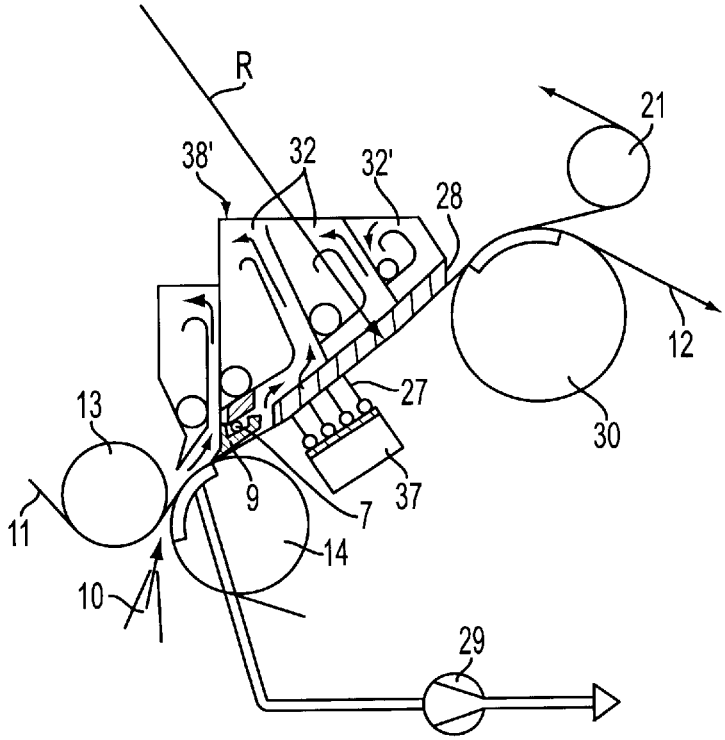

FIG. 6 depicts a more compact design compared with FIG. 5, in which the suction separator 33 is omitted. The dewatering box 38' has an additional vacuum chamber 32'. Wire suction roll 30 is positioned immediately downstream.

Figure 7:
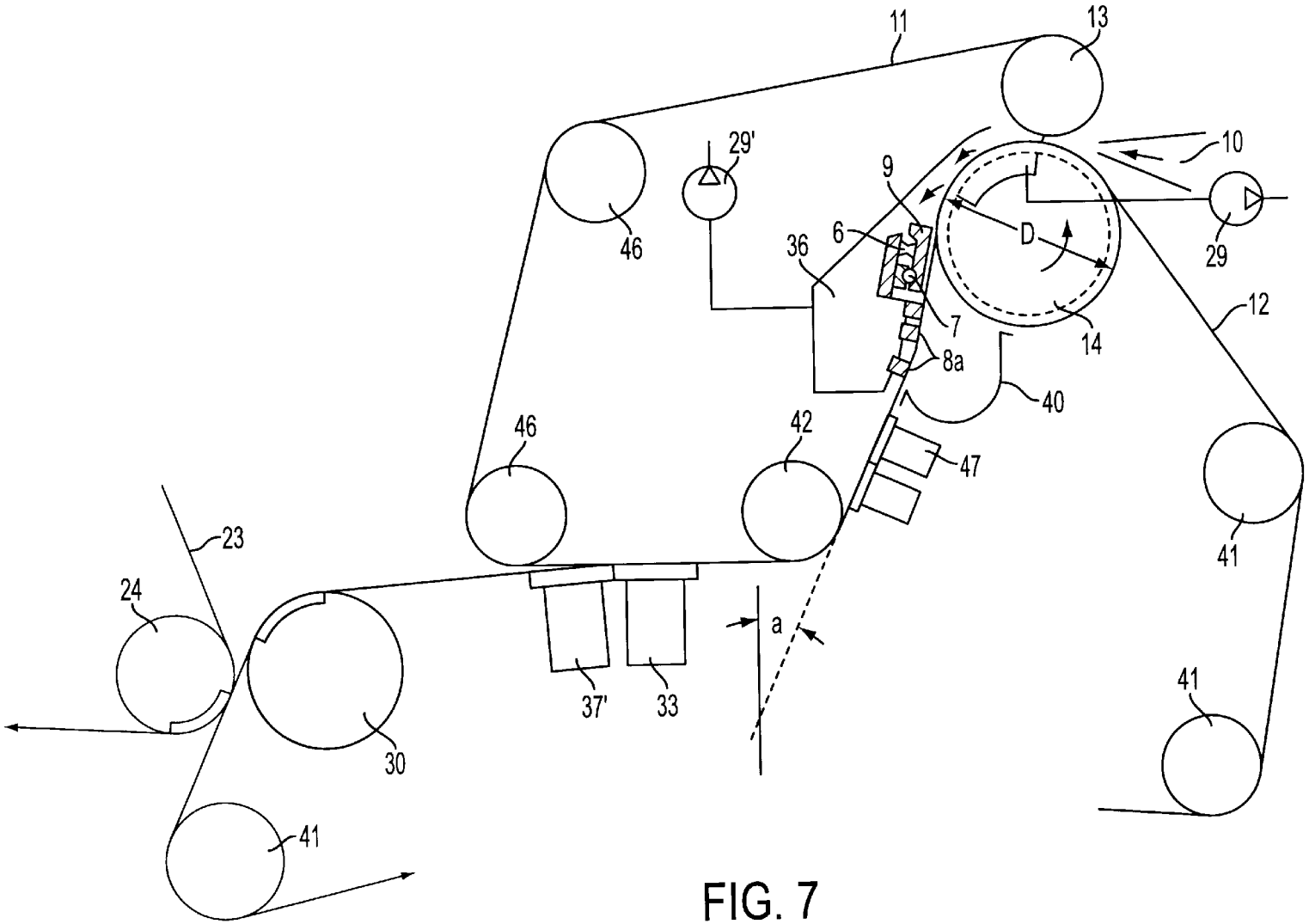

Referring now to FIG. 7, inner wire band 12 is a bottom wire band and outer wire band 11 is a top wire band. Before the outer wire band 11 contacts inner wire band 12 on the circumference of the forming roll 14, it runs over a breast roll 13. Together, wire bands 11 and 12 form a wedge-shaped intake gap between the two rolls 13 and 14, which receives a suspension of fibrous material directly from a headbox 10.

Headbox 10 is depicted only schematically. Preferably, it is a headbox equipped in a known manner with sectionally controllable addition of dilution water, for the purpose of setting a desired basis weight-cross-section of the finished paper web.

A water collection device 36 is positioned inside the loop of outer wire band 11 in the region of the forming roll 14. Initially, a large portion of the suspension water that passes through a top screen at the beginning of the twin-wire zone arrives there. This takes place substantially in the top descending quadrant of forming roll 14. At approximately the height of the axis of rotation of forming roll 14, wire bands 11 and 12 (with the web of fibrous material being formed between them) run off downwardly from forming roll 14. They then run over a convex forming shoe made up of skimmers 8*a* and disposed in the loop of inner wire band 12. Additional suspension water penetrates between skimmers 8*a* and collects in the collection device 36. An additional portion of the suspension water flows through the outer wire band 11 into a collection tray 40. Forming skimmers, which may be flexibly pressed in a known manner against the inner wire band 12, may be provided here (not depicted in FIG. 7). As an alternative to forming skimmers, at least one deflector may be associated with the inner wire band 12 in the region of skimmers 8*a*.

A jacket of the forming roll 14 has, in a known manner, recesses for temporary storage of water, e.g., a honeycomb covering and wire mesb attached thereon. In addition, if necessary, forming roll 14 may be designed as a suction roll with a vacuum source 29. The water collection device 36 disposed in the loop of outer wire band 11 may also be connected to a vacuum source 29'.

In FIG. 7, in the twin-wire zone, wire bands 11 and 12 run sharply downwardly immediately upon disengaging forming roll 14. In this region, the twin-wire zone forms an angle "a", between approximately 10 and 50°, with an imaginary vertical plane. In this section, outer wire band 11 is always located above inner wire 12. Preferably, the angle a is smaller than approximately 45°. In the sharply downwardly running section of the twin-wire zone, still more dewatering elements may be provided, e.g., suction boxes 47 contacting inner wire 12.

At the end of the sharply downwardly running section of the twin-wire zone, a deflecting roll 42 is provided, which deflects wire bands 11 and 12 into a substantially horizontal direction of travel. A suction separator 33, on which outer wire band 11 separates from inner wire band 12 and from the paper web thereon, is provided in the loop of inner wire band 12. Outer wire band 11 continues to run over guide rolls 46 back to the breast roll 13. Downstream from suction separator 33, inner wire band 12 runs, if necessary, over at least one additional suction box 37', to a wire suction roll 30, then over guide rolls 41 back to forming roll 14. Immediately downstream from wire suction roll 30, the paper web formed is removed from outer wire band 11 in a known manner by a felt 23 and a take-up roll 24.

Foil skimmer 9 or suction shoe 9 according to the invention with sharply downwardly running wire bands (similar to FIG. 7) may also be used in a twin-wire former according to German patent application 19651493.2, the disclosure of which is expressly incorporated by reference herein in its entirety; this is disposed on an endless wire to form a multi-layer paper web.

It is noted that the foregoing examples have been provided merely for the purpose of explanation and are in no way to be construed as limiting of the present invention. While the present invention has been described with reference to one or more exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A twin-wire former structured and arranged to form a web of fibrous material, comprising:

first and second endless circulating wire bands defining a twin-wire zone therebetween, and structured and arranged to form said web of fibrous material therebetween;

a forming roll, said first and second wire bands running over said forming roll in said twin-wire zone, said first wire band contacting said forming roll;

a reel-off point, defined as the point at which said first and second wire bands disengage from said forming roll; and a skimmer supported by a hinge, the skimmer having a slide surface contacting said second wire band, and a foil surface connected to the slide surface in a direction of travel of said wire bands, the foil surface diverging from the second wire at an angle of inclination, the skimmer extending crosswise over said second wire band and disposed in a region of said reel-off point;

wherein movement of said second wire band relative to said skimmer creates an area of reduced air pressure therebetween;

wherein a distance between said hinge and said second wire band is variable to adapt the angle of inclination between said foil surface and said second wire band, and thereby adapt the magnitude of said reduced air pressure.

2. The twin-wire former of claim 1, wherein said skimmer is pressed flexibly at said slide surface against said second wire band.

3. The twin-wire former of claim 2, wherein the hinge supports a downstream region of said skimmer, and an upstream region of said skimmer is supported by a flexible adjustment device.

4. The twin-wire former of claim 3, wherein said flexible adjustment device is a pneumatic hose.

5. The twin-wire former of claim 1, wherein a position of said skimmer is movable along a direction substantially parallel to a direction of travel of said second wire band.

6. The twin-wire former of claim 1, wherein said skimmer is disposed inside a loop defined by said second wire band, and said forming roll is disposed inside a loop defined by said first wire band, wherein said first wire band is below said second wire band.

7. The twin-wire former of claim 1, wherein said skimmer is disposed inside a loop defined by said second wire band, and said forming roll is disposed inside a loop defined by said first wire band, wherein said first wire band is above said second wire band.

8. The twin-wire former of claim 7, wherein said first and second wire bands run upwardly between said forming roll and said skimmer.

9. The twin-wire former of claim 7, wherein said first and second wire bands run downwardly between said forming roll and said skimmer.

10. A twin-wire former structured and arranged to form a web of fibrous material, comprising:

first and second endless circulating wire bands structured and arranged to form said web of fibrous material therebetween;

a forming roll, said first and second wire bands running over said forming roll, and said first wire band contacting said forming roll;

a reel-off point, defined by the point at which said first and second wire bands disengage from said forming roll; and a skimmer supported by a hinge, the skimmer having a slide surface contacting said second wire band, and a foil surface connected to the slide surface in a direction of travel of said wire bands, the foil surface diverging from the second wire at an angle of inclination, the skimmer extending crosswise over said second wire band and disposed in a region of said reel-off point;

wherein movement of said second wire band relative to said skimmer creates an area of reduced air pressure therebetween that assists in maintaining said second wire band at a desired alignment relative to said first wire band;

wherein a distance between said hinge and said second wire band is variable to adapt the angle of inclination between said foil surface and said second wire band, and thereby adapt the magnitude of said reduced air pressure.

11. The twin-wire former of claim 10, wherein said skimmer is pressed flexibly at said slide surface against said second wire band.

12. The twin-wire former of claim 11, wherein the hinge supports a downstream region of said skimmer, and an upstream region of said skimmer is supported by a flexible adjustment device.

13. The twin-wire former of claim 12, wherein said flexible adjustment device is a pneumatic hose.

14. A twin-wire former structured and arranged to form a web of fibrous material, comprising:

first and second endless circulating wire bands structured and arranged to form said web of fibrous material therebetween;

a forming roll, said first and second wire bands running over said forming roll, and said first wire band contacting said forming roll;

a reel-off point, defined by the point at which said first and second wire bands separate from said forming roll; and a foil skimmer supported by a hinge, the foil skimmer having a slide surface contacting said second wire band, and a foil surface connected to the slide surface in a direction of travel of said wire bands, the foil surface diverging from the second wire at an angle of inclination, the foil skimmer extending crosswise over said second wire band and being disposed in a region of said reel-off point;

wherein movement of said second wire band relative to said foil skimmer creates an area of reduced air pressure therebetween that at least partially offsets deviation in at least one of said first and second bands induced by another area of reduced air pressure between said first wire band and said forming roll in a region of said reel-off point;

wherein a distance between said hinge and said second wire band is variable to adapt the angle of inclination between said foil surface and said second wire band, and thereby adapt the magnitude of said reduced air pressure.

15. A method for operating a twin-wire former structured and arranged to form a web of fibrous material, said twin-wire former including: first and second wire bands defining a twin-wire zone therebetween, and structured and arranged to form said web of fibrous material therebetween, a skimmer supported by a hinge, the skimmer having a slide surface contacting said second wire band, and a foil surface connected to the slide surface in a direction of travel of said wire bands, the foil surface diverging from the second wire at an angle of inclination, a distance between said hinge and said second wire band being variable to adapt the angle of inclination between said foil surface and said second wire band, the skimmer extending crosswise over said second wire band and disposed in a region of a reel-off point, said method comprising:

moving said first and second wire bands adjacent a forming roll such that said first wire band contacts said forming roll;

disengaging said first and second wire bands from said forming roll at the reel-off point; and generating a reduced air pressure adjacent a side of said second wire band facing away from said forming roll, in a region of said reel-off point.

* * * * *